US006573812B1

(12) United States Patent
Wakamatsu et al.

(10) Patent No.: US 6,573,812 B1
(45) Date of Patent: Jun. 3, 2003

(54) DIELECTRIC FILTER, DUPLEXER, AND COMMUNICATION APPARATUS

(75) Inventors: Hiroki Wakamatsu, Kyoto (JP); Tomoyuki Ise, Nagaokakyo (JP); Shin Abe, Muko (JP); Kazuhiko Kubota, Muko (JP)

(73) Assignee: Murata Manufacturing Co., Ltd (JP)

( * ) Notice: Subject to any disclaimer, the term of this patent is extended or adjusted under 35 U.S.C. 154(b) by 0 days.

(21) Appl. No.: 09/543,522

(22) Filed: Apr. 6, 2000

(30) Foreign Application Priority Data

Apr. 9, 1999 (JP) ..... 11-102964

(51) Int. Cl.[7] ..... H01P 7/10; H01P 5/12; H01P 1/20

(52) U.S. Cl. ..... 333/219.1; 333/134; 333/202

(58) Field of Search ..... 333/219.1, 134, 333/202

(56) References Cited

U.S. PATENT DOCUMENTS 4,963,841 A * 10/1990 Sparagna ..... 333/202
5,221,913 A * 6/1993 Ishizaki et al. ..... 333/219.1
5,677,654 A * 10/1997 Sarkka ..... 333/219.1
6,057,745 A * 5/2000 Sonoda et al. ..... 333/134

FOREIGN PATENT DOCUMENTS

EP 0104735 A2 8/1983
EP 0817303 A2 1/1998

OTHER PUBLICATIONS

European Search Report dated Mar. 11, 2002.
Schornstein, S. et al., "High–Temperature Superconductor –Shielded High Power Dielectric Dual–Mode Filter For Applications In Satellite Communications" 1998 IEEE MTT–S International Microwave Symposium Digest, New York, NY, IEEE, vol. 3, pp. 1319–1322, XP000825038.
Cousty, J.P. et al., "Finite Elements For Microwave Device Simulation: Application To Microwave Dielectric Resonator Filters", IEEE Transactions On Microwave Theory and Techniques, IEEE Inc., New York, NY, vol. 40, No. 5, pp. 925–932, XP000271379.
Peng, H. et al., "High Tuning Coefficient Whispering Gallery Modes In A Sapphire Dielectric Resonator Transducer", Proceedings of the International Frequency Control Symposium, Boston, Jun. 1–3, 1994, New York, IEEE, vol. Symp. 48, pp. 459–465, XP000625542.

* cited by examiner

*Primary Examiner*—Patricia T. Nguyen
(74) *Attorney, Agent, or Firm*—Dickenstein, Shapiro Morin & Oshinsky, LLP

(57) ABSTRACT

A dielectric filter in which a desirable amount of coupling is obtainable, and the positions of an input coupling unit and an output coupling unit can be easily arranged. The dielectric filter includes a shield case, a dielectric resonator disposed inside the shield case, a supporting base for supporting the dielectric resonator, the input coupling unit, and the output coupling unit. Both the input coupling unit and the output coupling unit are coupled to the dielectric resonator. The output coupling unit is a probe with an open-circuited end, extending on a side where the supporting base of the dielectric resonator is disposed.

5 Claims, 7 Drawing Sheets

DIELECTRIC FILTER, DUPLEXER, AND COMMUNICATION APPARATUS

BACKGROUND OF THE INVENTION

1. Field of the Invention

The present invention relates to dielectric filters, duplexers, and communication devices incorporating the same, which are used in base stations having high-frequency communication apparatus.

2. Description of the Related Art

A conventional dielectric filter 110 will be illustrated with reference to FIGS. 11 and 12. FIG. 11 is a side view of the conventional dielectric filter 110, and FIG. 12 is a plan view thereof. In these figures, shield cases are cut away to show the inside of the filter 110.

As shown in FIGS. 11 and 12, the conventional dielectric filter 110 comprises a cylindrical dielectric resonator 111, a supporting base 112 for supporting the dielectric resonator 111, and a metal shield case 113 for containing the dielectric resonator 111 and the supporting base 112. In addition, a loop 115 as an input coupling unit and a probe 116 as an output coupling unit are attached to the shield case 113 such that the loop 115 and the probe 116, respectively, are coupled to the dielectric resonator 111.

In this arrangement, the loop 115 is formed by connecting an end of a metal line or a metal plate to the shield case 113 to be grounded, and connecting the other end thereof, for example, to the central conductor of a coaxial connector so as to perform a magnetic-field coupling with the dielectric resonator 111. In general, a loop has a structure in which one end of the loop is connected to a shield case, and the other end thereof is connected to a central conductor to retain both ends of the loop. This structure permits filter characteristics to be stabilized, since the position of the loop does not change due to influence from the outside, and the amount of coupling can be maintained constant.

Meanwhile, regarding the probe, an electric-field coupling is performed between the probe and a dielectric resonator by making an end of a metal line open, and connecting the other end thereof, for example, to the central conductor of a coaxial connector. In the electric-field coupling between the probe and the dielectric resonator, the amount of coupling with the dielectric resonator is larger than the amount of coupling between a dielectric resonator and a loop having the same length as that of the probe.

In the conventional dielectric filter 110 having such a structure, a signal is inputted from the loop 115 as the input coupling unit so as to couple the loop 115 with the TE 01δ mode of the dielectric resonator 111. After this, the dielectric resonator 111 and the probe 116 as the output coupling unit are coupled so as to output only the signals of a specified frequency band.

As an input coupling unit and an output coupling unit, besides the combination of a loop and a probe, the combination of only loops, and the combination of only probes are conventionally known.

Next, referring to FIGS. 13 and 14, a description will be given of a multi-mode dielectric filter proposed by the assignee of the present application in Japanese Patent Application No. 10-220371 which was not laid-open to the public at the time of the priority date of this application. Thus, the disclosures of the drawings as well as the contents of the Japanese application do not constitute prior art. FIG. 13 is a side view of the multi-mode dielectric filter denoted by reference numeral 120, and FIG. 14 is a plan view thereof. In each of these figures, a shield case is cut away to show the inside of the filter.

As shown in FIGS. 13 and 14, the multi-mode dielectric filter 120 comprises a dielectric resonator 121, a supporting base 112 for supporting the dielectric resonator 121, and a metal shield case 113 containing the dielectric resonator 121 and the supporting base 112. In addition, a loop 125*a* as an input coupling unit and another loop 125*b* as an output coupling unit are attached to the shield case 113 so that the loops 125*a* and 125*b* are respectively coupled with the dielectric resonator 121.

The dielectric resonator 121 has a configuration seen as if it were formed by cutting away four corners of a square when observed from above. With this configuration, the dielectric resonator 121 can be used as a triple-mode dielectric resonator, which resonates in three resonant modes shown in FIG. 5, such as the TM $\mathbf{01}\delta_{x+y}$ mode, the TE $\mathbf{01}\delta_{Z}$ mode, and the TM $\mathbf{01}\delta_{x-y}$ mode. In this case, each of the subscripts x, y, and z indicates each of the directions of x, y, and z set as an axial direction. For example, the TM $\mathbf{01}\delta_{x+y}$ mode is equivalent to the TM 01δ mode obtained when the sum of a vector x and a vector y is set as the axial direction. The axis z indicates upper and lower directions, and the electric field is indicated by a solid line, whereas the magnetic field is indicated by a broken line.

In the multi-mode dielectric resonator 120 having such a structure, the loop 125*a* as the input coupling unit is positioned in a direction perpendicular to the magnetic field of the TM $\mathbf{01}\delta_{x+y}$ mode so as to couple the loop 125*a* and the TM $\mathbf{01}\delta_{x+y}$ mode of the dielectric resonator 121. Then, the TM $\mathbf{01}\delta_{x+y}$ mode and the TE $\mathbf{01}\delta_{Z}$ mode are coupled, and furthermore, the TE $\mathbf{01}\delta_{Z}$ mode and the TM $\mathbf{01}\delta_{x-y}$ mode are coupled. Lastly, the TM $\mathbf{01}\delta_{x-y}$ mode of the dielectric resonator 121 is coupled with the loop 125*b* as the output coupling unit positioned in a direction perpendicular to the magnetic field of the TM $\mathbf{01}\delta_{x-y}$ mode. This structure permits the multi-mode dielectric filter 120 to serve as a three-stage band pass filter.

In the conventional dielectric filter, both the input coupling unit and the output coupling unit are positioned on the upper side of the dielectric resonator. In this case, the positions of the input coupling unit and the output coupling unit are determined by considering the amount of coupling between the input coupling unit and the dielectric resonator, and the amount of coupling between the output coupling unit and the dielectric resonator.

However, as shown above, when the input coupling unit and the output coupling unit are relatively close to each other, a relatively great mutual influence is generated between the input coupling unit and the output coupling unit. Therefore, when the positions for arranging both the input coupling unit and the output coupling unit are determined, it is necessary to consider the mutual influence generated between the coupling units. This makes designing of the filter difficult. Similarly, this problem often occurs in a case in which an input coupling unit and an output coupling unit are disposed on the side positions of the dielectric resonator.

In contrast, in the multi-mode dielectric filter proposed in Japanese Patent Application No. 10-220371, the two resonant modes orthogonal to each other are coupled to the input coupling unit and the output coupling unit. As a result, in order not to make the input coupling unit and the output coupling unit mutually intersect in a space-limited structure, it is necessary to reduce the lengths of both the input coupling unit and the output coupling unit.

Meanwhile, in order to increase the amount of coupling between the dielectric resonator and the input coupling unit, and the amount of coupling between the dielectric resonator and the output coupling unit, it is necessary to increase the lengths of the input coupling unit and the output coupling unit. However, in such a dielectric filter, due to a space limitation in the structure, the lengths of the input coupling unit and the output coupling unit must be reduced. Furthermore, the loops are used as the input coupling unit and the output coupling unit. Thus, no great amount of coupling can be obtained. In other words, in the multi-mode dielectric filter proposed in Japanese Patent Application No. 10-220371, in addition to the above problem, when filter characteristics with a broad pass bandwidth are required, it is impossible to increase the amounts of coupling between the dielectric resonator and the respective coupling units. As a result, there is a problem in that the desired filter characteristics can not be obtained.

SUMMARY OF THE INVENTION

Accordingly, it is an object of the present invention to solve the above problems and provide a dielectric filter, a duplexer, and a communication apparatus incorporating the same, in which the positions of an input coupling unit and an output coupling unit can be easily arranged, and the amounts of couplings between a dielectric resonator and the coupling units can be sufficiently obtained.

To this end, according to a first aspect of the present invention, there is provided a dielectric filter including a shield case having conductivity; a dielectric resonator disposed inside the shield case; a supporting base integrally formed with the dielectric resonator or separately formed therefrom so as to support the dielectric resonator; an input coupling unit and an output coupling unit for coupling to the dielectric resonator; in which one of the input coupling unit and the output coupling unit is a probe with an open-circuited end, the probe extending on a side where the supporting base of the dielectric resonator is disposed.

When one of the input coupling unit and the output coupling unit extends on the side where the supporting base of the dielectric resonator is disposed, the input coupling unit and the output coupling unit are positioned such that the units do not influence each other. As a result, designing for positioning the input coupling unit and the output coupling unit can be easily performed. Furthermore, since the coupling unit extending on the side where the supporting base is disposed is formed by the probe, it is not necessary to increase the length of the coupling unit in order to obtain a desired amount of coupling, and there is no problem in that the limitation to the length of the coupling unit caused by the presence of the supporting base hinders obtaining a sufficient amount of coupling.

In addition, in the above dielectric filter, the dielectric resonator may be a multi-mode dielectric resonator having at least two resonant modes substantially orthogonal to each other.

When the input coupling unit and the output coupling unit are disposed so as to be coupled to the multi-mode dielectric resonator having at least two resonant modes substantially perpendicular to each other, directions in which the input coupling unit and the output coupling unit extend are equivalent to directions toward the center of the dielectric resonator when observed from above. With the structure of this dielectric filter, it is easy to design the positions for arranging the input coupling unit and the output coupling unit and obtain a sufficient amount of coupling. That is, in this dielectric filter, since the input coupling unit and the output coupling unit are disposed away from each other so as to prevent influence on each other, and the coupling unit extending on the side where the supporting base is disposed is formed by the probe, it is not necessary to increase the length of the coupling unit in order to obtain the desired amount of coupling, and the presence of the supporting base does not hinder the extending unit from coupling with the resonator.

In addition, according to a second aspect of the present invention, there is provided a duplexer including at least two filters; input/output connecting units connected to the filters; and an antenna connecting unit commonly connected to the filters; in which at least one of the filters is the dielectric filter in accordance with the first aspect of the invention.

In addition, according to a third aspect of the present invention, there is provided a communication apparatus including the duplexer in accordance with the second aspect of the invention; a transmission circuit connected to at least one of the input/output connecting units of the duplexer; a reception circuit connected to at least one of the input/output connecting units, which is not the input/output connecting unit connected to the transmission circuit; and an antenna connected to the antenna connecting unit of the duplexer.

This arrangement can provide a duplexer and a communication apparatus, in which designing for positioning the input coupling unit and the output coupling unit can be facilitated, and required characteristics can be obtained.

Other features and advantages of the present invention will become apparent from the following description of the invention which refers to the accompanying drawings.

BRIEF DESCRIPTION OF THE DRAWING(S)

DETAILED DESCRIPTION OF EMBODIMENTS OF THE INVENTION

Figure 1:
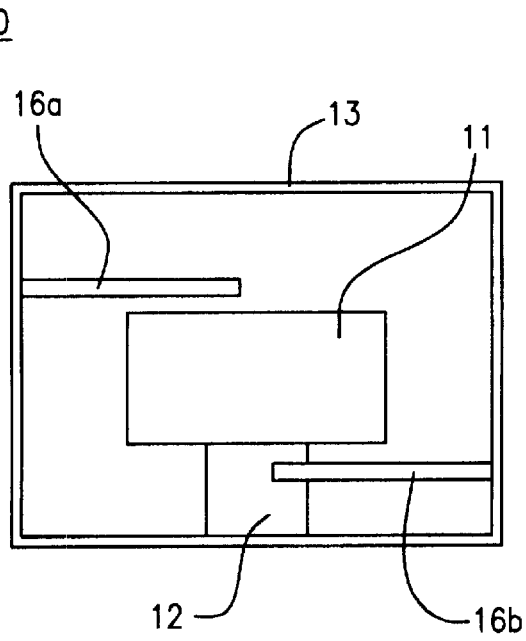
FIG. 1 is a side view of a dielectric filter according to a first embodiment of the present invention.
Figure 2:
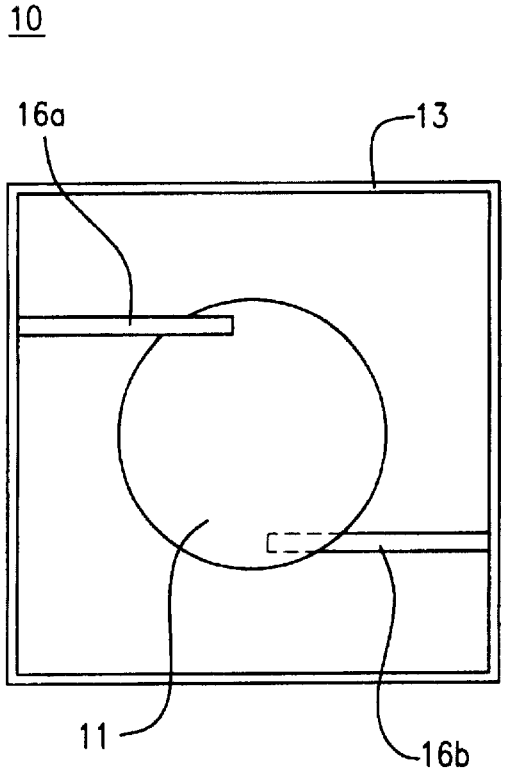
FIG. 2 is a plan view of the dielectric filter according to the first embodiment of the present invention.

Referring now to FIGS. 1 and 2, a description will be given of a dielectric filter according to a first embodiment of the present invention. FIG. 1 is a side view of the dielectric filter of the first embodiment, and FIG. 2 is a plan view thereof. In each of these figures, the shield case is cut away to show the inside of the filter.

As shown in FIGS. 1 and 2, the dielectric filter denoted by reference numeral 10, in this embodiment, comprises a cylindrical dielectric resonator 11, a supporting base 12 for supporting the dielectric resonator 11, and a metal shield case 13 containing the dielectric resonator 11 and the supporting base 12. In addition, a probe 16*a* as an input coupling unit and a probe 16*b* as an output coupling unit are attached to the shield case 13, and are positioned such that the probes 16*a* and 16*b* are coupled with the dielectric resonator 11. One end of each of the probes 16*a* and 16*b* is, for example, connected to the central conductor of a coaxial connector attached to the shield case 13 so as to be connected to an external circuit. In the figures, the central conductor of the coaxial connector is not shown.

In this case, the probe 16*a* as the input coupling unit extends on the upper side of the dielectric resonator 11, and the probe 16*b* as the output coupling unit extends on the lower side thereof, that is, on a side where the supporting base 12 is disposed. When the input coupling unit and the output coupling unit are disposed in such positions, the mutual influence between the input coupling unit and the output coupling unit can be reduced so that there is almost no disturbing influence on each other. As a result, designing for positioning the input coupling unit and the output coupling unit can be facilitated. Furthermore, since the output coupling unit is formed by the probe, it is unnecessary to increase the length of the output coupling unit in order to obtain a sufficient amount of coupling.

In the dielectric filter 10 having such a structure, when a signal is inputted from the probe 16*a* as the input coupling unit, the probe 16*a* and the TE 01δ mode are coupled. Sequentially, the dielectric resonator 11 and the probe 16*b* as the output coupling unit are coupled to output only the signals of a specified frequency band.

Figure 3:
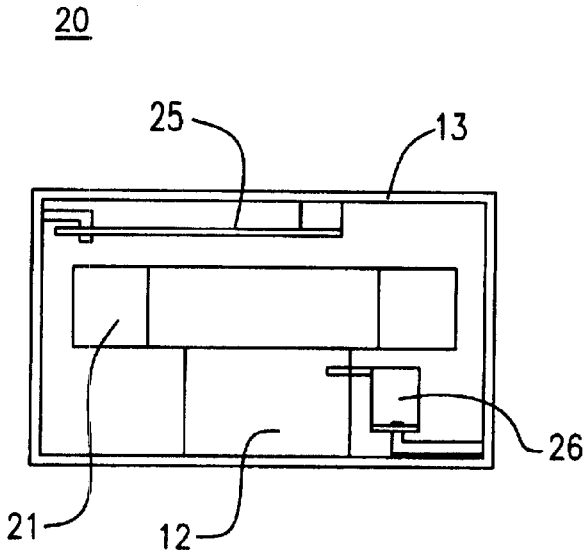
FIG. 3 is a side view of a multi-mode dielectric filter according to a second embodiment of the present invention.
Figure 4:
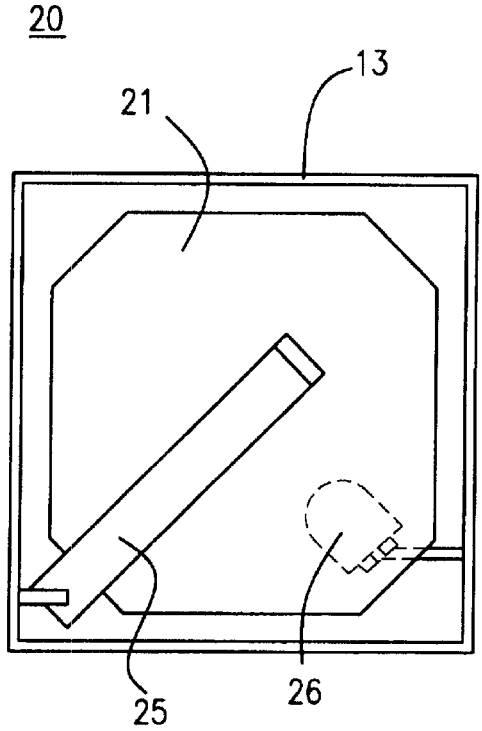
FIG. 4 is a plan view of the multi-mode dielectric filter according to the second embodiment of the present invention.

Next, a multi-mode dielectric filter according to a second embodiment of the present invention will be illustrated by referring to FIGS. 3 and 4. FIG. 3 is a side view of the multi-mode dielectric filter of the second embodiment, and FIG. 4 is a plan view thereof. A shield case is cut away to show the inside of the filter.

As shown in FIGS. 3 and 4, the multi-mode dielectric filter of this embodiment, which is denoted by reference numeral 20, comprises a dielectric resonator 21, a supporting base 12 for supporting the dielectric resonator 21, and a metal shield case 13 containing the dielectric resonator 21 and the supporting base 12. In addition, a loop 25 as an input coupling unit and a probe 26 as an output coupling unit are attached to the shield case 13 to be each coupled with the dielectric resonator 21.

Figure 5A:
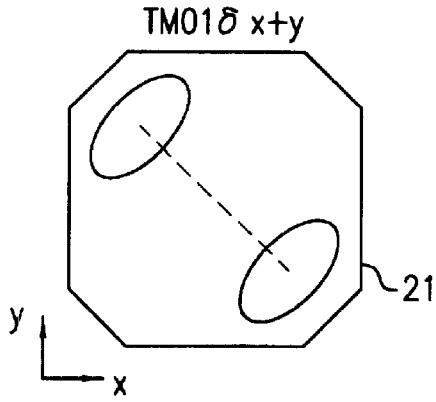
FIGS. 5A to 5C are views of three modes of a triple-mode dielectric resonator.
Figure 5B:
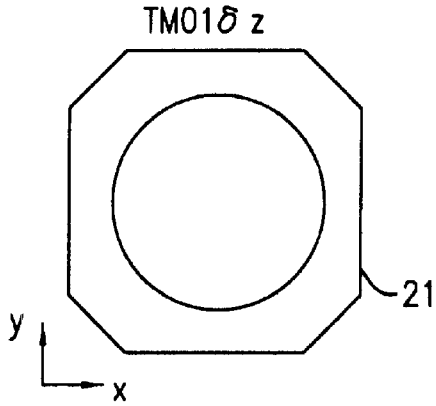
Figure 5C:
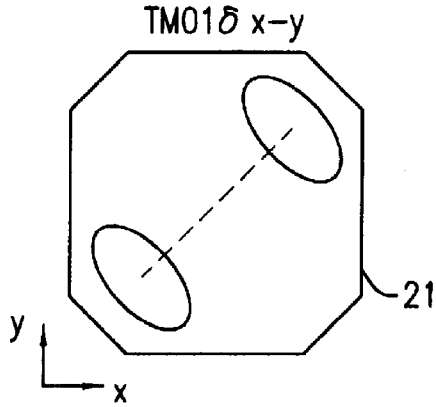

The dielectric resonator 21 has a configuration seen as if it were formed by cutting away four corners of a square when observed from above. With this configuration, the dielectric resonator 21 can be used as a triple-mode dielectric resonator, which resonates in three resonant modes shown in FIG. 5, such as the TM 01$\delta_{x+y}$ mode, the TE 01$\delta_Z$ mode, and the TM 01$\delta_{x-y}$ mode. In this case, the subscripts x, y, and z indicate the directions of x, y, and z set as axial directions. For example, the TM 01$\delta_{x+y}$ mode is the TM 01δ mode obtained when the sum of a vector x and a vector y is set as the axial direction. The axis z indicates upper and lower directions, and the electric field is indicated by a solid line, whereas the magnetic field is indicated by a broken line.

In the multi-mode dielectric resonator 21 having such a structure, the loop 25 as the input coupling unit extends in a direction perpendicular to the magnetic field of the TM 01δx+ymode on the upper side of the dielectric resonator 21. The probe 26 as the output coupling unit extends in a direction perpendicular to the magnetic field of the TM 01$\delta_{x-y}$ mode on the lower side of the dielectric resonator 21, that is, on the side where the supporting base 12 is disposed. By disposing the input coupling unit and the output coupling unit at such positions, the mutual influence between the input coupling unit and the output coupling unit can be reduced so that there is almost no serious problem caused by the influence. Furthermore, this arrangement can facilitate designing for positioning the input-coupling unit and the output-coupling unit. Furthermore, since the output coupling unit is formed by the probe, it is unnecessary to increase the length of the output coupling unit in order to obtain a sufficient amount of coupling. Therefore, even when the probe 26 is extended in a direction perpendicular to the magnetic world of the TM 01$\delta_{x-y}$ mode, that is, on the side where the supporting base 12 of the dielectric resonator 21 is disposed, the supporting base 12 is not a hindrance. Furthermore, similarly, regarding the loop 25 extending on the upper side of the dielectric resonator 21, there is no need to consider intersecting of the output coupling unit and the loop 25. Accordingly, it is possible to increase the length of the loop 25 to some extent in order to obtain a desired amount of coupling.

In the multi-mode dielectric filter 20 having such a structure, the loop 25 as the input coupling unit and the TM 01$\delta_{x+y}$ mode of the dielectric resonator 21 are coupled. Then, the TM 01$\delta_{x+y}$ mode and the TE 01$\delta_Z$ mode are coupled, and sequentially, the TE 01$\delta_Z$ mode and the TM 01$\delta_{x-y}$ mode are coupled. Lastly, the probe 26 as the output coupling unit and the TM 01$\delta_{x-y}$ mode of the dielectric resonator 21 are coupled so that the multi-mode dielectric filter 20 serves as a three-stage band pass filter.

Figure 6:
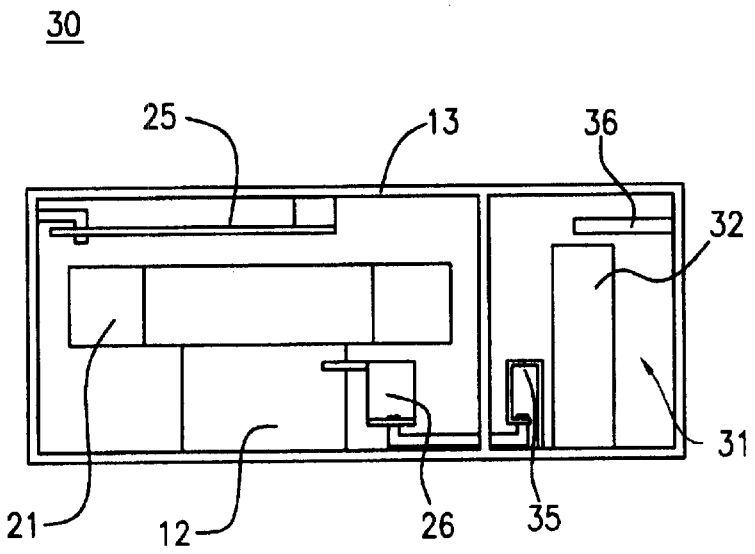
FIG. 6 is a side view of a filter according to a third embodiment of the present invention.
Figure 7:
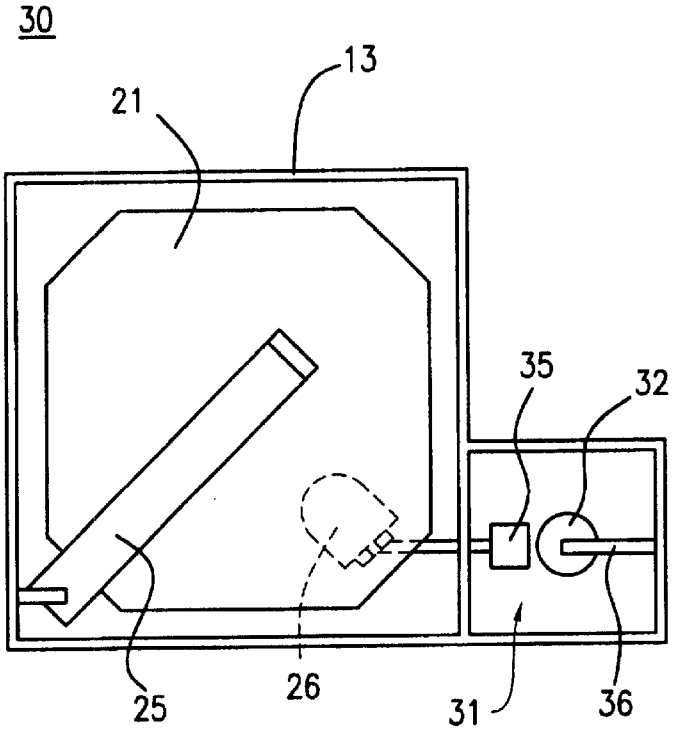
FIG. 7 is a plan view of the filter according to the third embodiment of the present invention.

Referring now to FIGS. 6 and 7, a description will be given of a dielectric filter according to a third embodiment of the present invention. FIG. 6 is a side view of the dielectric filter of the third embodiment, and FIG. 7 is a plan view thereof. In each of these figures, the shield case is cut away to show the inside of the filter. In addition, the same reference numerals are given to the same parts as those shown in the above embodiments, and the explanation thereof is omitted.

As shown in FIGS. 6 and 7, in the dielectric filter 30 of this embodiment, a triple-mode dielectric resonator 21 and a hollow resonator 31 are disposed by putting a metal plate therebetween so that the dielectric filter 30 serves as a four-stage band pass filter. The hollow resonator 31 is formed by disposing a cylindrical conductor 32 with an end connected to a shield case 13 and the other end open-circuited at the center inside the a metal-plate shield case 13. In this situation, the cylindrical conductor 32 is used as a central conductor, and the shield case 13 is used as a ground conductor.

In the filter 30 of the third embodiment, a loop 25 as an input coupling unit is extended on the upper side of the dielectric resonator 21, and a probe 36 as an output coupling unit is extended on the upper side of the hollow resonator 31. In addition, an inter-resonator coupling unit formed by a probe 26 and a loop 35 is disposed between the dielectric resonator 21 and the hollow resonator 31. The probe 26 of the inter-resonator coupling unit extends on the side where a supporting base 12 of the dielectric resonator 21 is disposed, and the loop 35 extends on the side where the hollow resonator 31 is disposed.

In this arrangement, since the probe 26 of the inter-resonator coupling unit extending on the side where the dielectric resonator 21 is disposed can be regarded as the output coupling unit described in the present invention, the same advantages provided in the above embodiments can be obtained in this embodiment.

In the third embodiment of the invention, the four-stage band pass filter is formed by the triple-mode dielectric resonator 21 and the hollow resonator 31. However, by changing the positions for connecting the input coupling unit and the output coupling unit, a three-stage band pass filter may be formed by the dielectric resonators, and the hollow resonator may be used as a trap.

Figure 8:
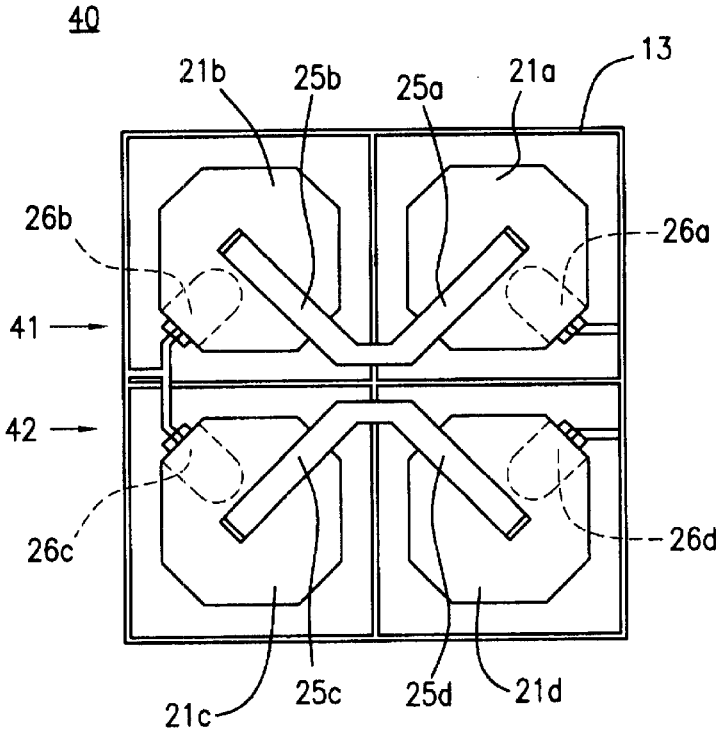
FIG. 8 is a plan view of a duplexer according to a fourth embodiment of the present invention.

Furthermore, a duplexer according to a fourth embodiment of the present invention will be illustrated with reference to FIG. 8. FIG. 8 is a plan view of the duplexer of the fourth embodiment, and the shield case is cut away to show the inside of the duplexer. In this duplexer, the same reference numerals are given to the same parts as those shown in the second embodiment, and the explanation thereof is omitted.

As shown in FIG. 8, the duplexer 40 of this embodiment includes a transmission dielectric filter 41 and a reception dielectric filter 42. The transmission dielectric filter 41 is formed by disposing two triple-mode dielectric resonators 21*a* and 21*b*, between which a metal plate is disposed, and the reception dielectric filter 42 is formed by disposing two triple-mode dielectric resonators 21*c* and 21*d*, between which a metal plate is disposed.

The input coupling unit of the transmission dielectric filter 41 is formed by a probe 26*a*, and is connected to an external transmission circuit. In addition, the output coupling unit of the reception dielectric filter 42 is formed by a probe 26*d*, and is connected to an external reception circuit. The output coupling unit of the transmission dielectric filter 41 is formed by a prove 26*b*, and the input coupling unit of the reception dielectric filter 42 is formed by a probe 26*c*, and both of them are commonly connected to an external antenna. The probes 26*a* and 26*c* as the input coupling units are extended on sides where supporting bases of the dielectric resonators 21*a* and 21*c* are disposed, and the probes 26*b* and 26*d* as the output coupling units are extended on sides where the supporting bases of the dielectric resonators 21*b* and 21*d* are disposed.

In addition, as inter-resonator coupling units, two loops 25*a* and 25*b* are disposed between the resonators of the transmission dielectric filter 41, and two loops 25*c* and 25*d* are disposed between the resonators of the reception dielectric filter 42, respectively.

As shown here, in the duplexer 40 of this embodiment, the loops 25*a*, 25*b*, 25*c*, and 25*d* are used as the inter-resonator coupling units. However, as in the case of a duplexer 40*a* shown in FIG. 9, probes 26*a*, 26*b*, 26*c*, and 26*d* may be used as inter-resonator coupling units.

Figure 9:
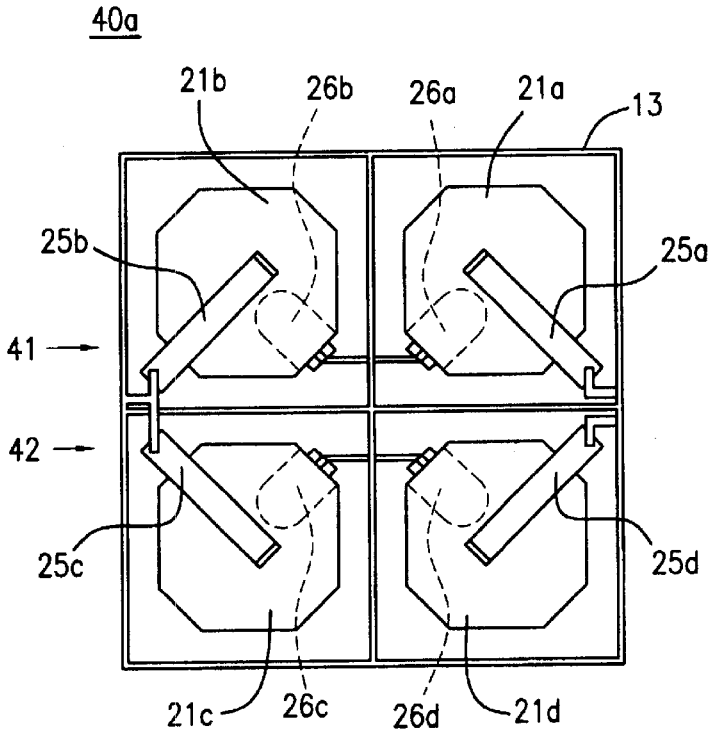
FIG. 9 is a plan view of a modified example of the duplexer according to the fourth embodiment of the present invention.

The input coupling unit and the output coupling unit shown in FIG. 8, and the probes 26*a*, 26*b*, 26*c*, and 26*d* as the inter-resonator coupling units shown in FIG. 9 are equivalent to the input coupling unit and the output coupling unit extending on the side where the supporting base is disposed in the present invention. With this arrangement, the advantages of the present invention such as facilitated designing for arranging the input/output coupling units and an increase in the amount of coupling can be obtained.

In the duplexers 40 and 40*a* having such structures in accordance with the fourth embodiment, only a signal having a specified frequency is passed by the transmission dielectric filter 41, and a signal having a frequency different from the frequency of the transmission dielectric filter 41 is passed by the reception dielectric filter 42.

Figure 10:
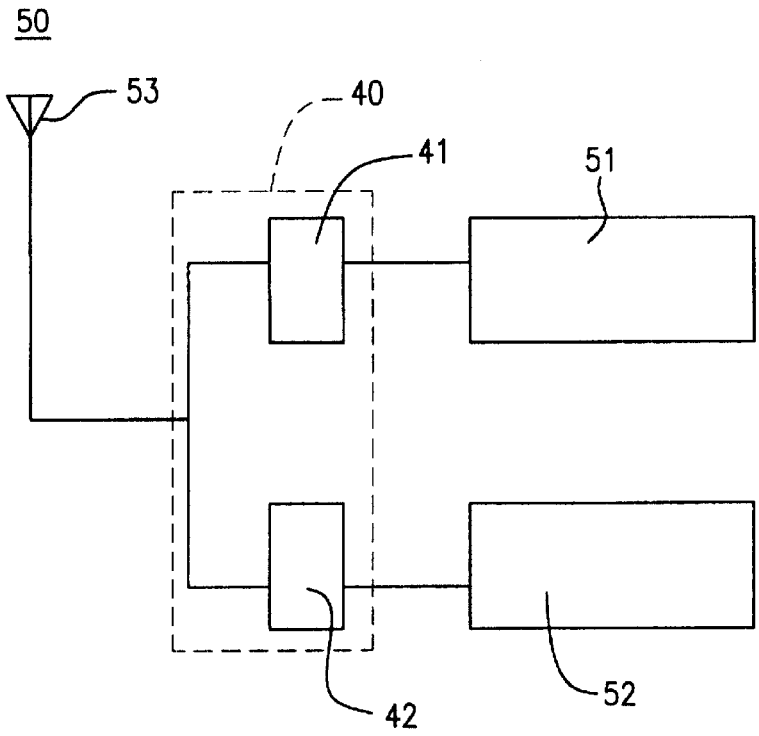
FIG. 10 is a schematic view of a communication apparatus according to a fifth embodiment of the present invention.
Figure 11:
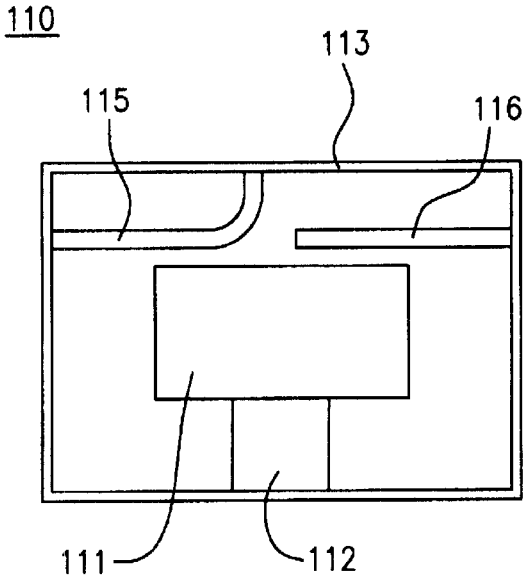
(PRIOR ART) FIG. 11
FIG. 11 is a side view of a conventional dielectric filter.
Figure 12:
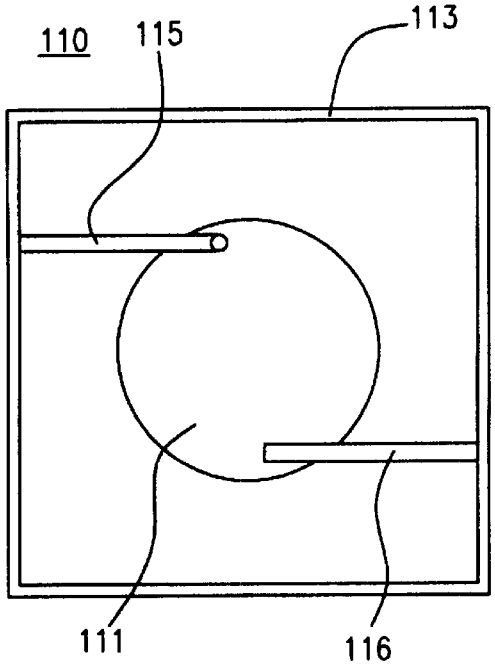
(PRIOR ART) FIG. 12
FIG. 12 is a plan view of the conventional dielectric filter.
Figure 13:
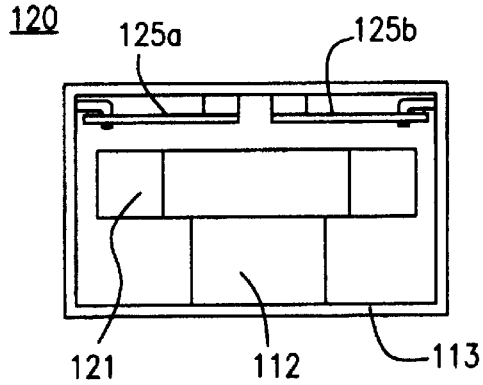
FIG. 13 is a side view of a dielectric filter previously proposed by the assignee of the present application.
Figure 14:
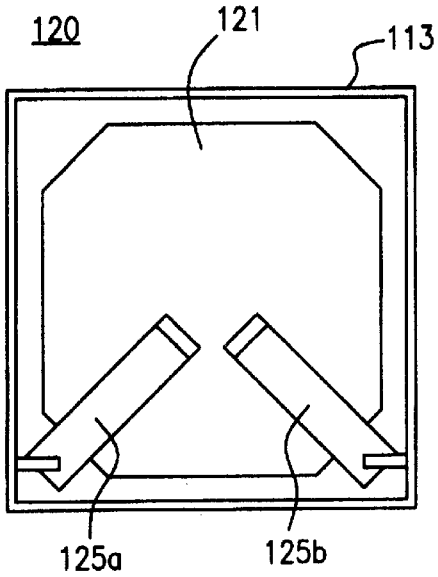
FIG. 14 is a plan view of the dielectric filter previously proposed by the assignee of the present application.

In addition, a communication apparatus according to a fifth embodiment of the present invention will be illustrated with reference to FIG. 10. FIG. 10 is a schematic view of a communication apparatus 50 of the fifth embodiment.

As shown in FIG. 10, the communication apparatus 50 comprises the duplexer 40, a transmission circuit 51, a reception circuit 52, and an antenna 53. In this case, the duplexer 40 is equivalent to the duplexer shown in the previous embodiment. The input coupling unit connected to the transmission dielectric filter 41 shown in FIG. 8 is connected to the transmission circuit 51. The output coupling unit connected to the reception dielectric filter 42 shown in FIG. 8 is connected to the reception circuit 52. In addition, the output coupling unit of the transmission dielectric filter 41 is integrated with the input coupling unit of the reception dielectric filter 42 to be connected to the antenna 53.

As described above, according to the present invention, in the dielectric filter having an input coupling unit and an output coupling unit, a dielectric resonator supported by a supporting base is disposed inside a shield case. One of the input coupling unit and the output coupling unit is a probe, which is extended on the side where the supporting base of the dielectric resonator is disposed. With this arrangement, when the positioning of the input coupling unit and the output coupling unit is designed, it is unnecessary to consider mutual influence between the input coupling unit and the output coupling unit, so that designing of the positioning can be facilitated. In addition, with the probe, since the coupling between the dielectric resonator and the coupling unit is set as an electric-field coupling, it is substantially unnecessary to increase the length of the probe in order to obtain a desired amount of coupling, and there is no problem in that the desired amount of coupling cannot be obtained due to the presence of the supporting base.

Particularly, when the dielectric resonator is a multi-mode resonator having two resonant modes perpendicular to each other, the input coupling unit and the output coupling unit are each oriented toward the center of the dielectric resonator when observed from above. However, in the present invention, since one of the coupling units is extended on the side where the supporting base of the dielectric resonator is disposed, it is unnecessary to consider intersection of the input coupling unit and the output coupling unit. Furthermore, since the probe is used as the coupling unit extending on the side where the supporting base of the dielectric resonator is disposed, it is unnecessary to increase the length of the probe in order to obtain the desired amount of coupling, and the presence of the supporting base is not a hindrance even when the coupling unit is oriented toward the center of the dielectric resonator.

In addition, while the invention has been described in its preferred embodiments, it is to be understood by those skilled in the art that obviously modifications and variations can be made without departing from the scope and spirit of the invention.

What is claimed is:

1. A dielectric filter comprising:

a conductive shield case;

a dielectric resonator disposed inside the shield case;

a supporting base formed in one of an integral fashion and a separate fashion with the dielectric resonator so as to support the dielectric resonator;

an input coupling unit and an output coupling unit for coupling to the dielectric resonator;

wherein one of the input coupling unit and the output coupling unit is a probe with an open-circuited end, which extends on a side of the dielectric resonator where the supporting base of the dielectric resonator is disposed and alongside the supporting base, the input and output coupling units being disposed on opposite sides of the dielectric resonator and adjacent a perimeter of the dielectric resonator.

2. The dielectric filter of claim 1, wherein the dielectric resonator is a multi-mode dielectric resonator having at least two resonant modes approximately orthogonal to each other.

3. The dielectric filter of claim 1, further comprising a second dielectric resonator, an inter-resonator coupling unit comprising a probe and a loop disposed between the dielectric resonator and the second dielectric resonator, the input coupling unit being coupled to the dielectric resonator and the output coupling unit being coupled to the second dielectric resonator.

4. A duplexer comprising:

at least two filters;

an input/output connecting unit connected to the filters; and an antenna connecting unit commonly connected to the filters;

wherein at least one of the filters comprises a dielectric filter comprising:

a conductive shield case;

a dielectric resonator disposed inside the shield case;

a supporting base formed in one of an integral fashion and a separate fashion with the dielectric resonator so as to support the dielectric resonator;

an input coupling unit and an output coupling unit for coupling to the dielectric resonator;

wherein one of the input coupling unit and the output coupling unit is a probe with an open-circuited end, which extends on a side of the dielectric resonator where the supporting base of the dielectric resonator is disposed and alongside the supporting base, the input and output coupling units being disposed on opposite sides of the dielectric resonator and adjacent a perimeter of the dielectric resonator.

5. A communication apparatus comprising:

a duplexer comprising:

at least two filters;

an input/output connecting unit connected to the filters; and an antenna connecting unit commonly connected to the filters;

wherein at least one of the filters comprises a dielectric filter comprising:

a conductive shield case;

a dielectric resonator disposed inside the shield case;

a supporting base formed in one of an integral fashion and a separate fashion with the dielectric resonator so as to support the dielectric resonator;

an input coupling unit and an output coupling unit for coupling to the dielectric resonator;

wherein one of the input coupling unit and the output coupling unit is a probe with an open-circuited end, which extends on a side of the dielectric resonator where the supporting base of the dielectric resonator is disposed and alongside the supporting base, the input and output coupling units being disposed on opposite sides of the dielectric resonator and adjacent a perimeter of the dielectric resonator; the communication apparatus further comprising:

a transmission circuit connected to at least one of the input/output connecting unit of the duplexer;

a reception circuit connected to at least one of the input/output connecting unit which is not connected to the transmission circuit; and an antenna connected to the antenna connecting unit of the duplexer.

* * * * *